US010219671B2

(12) United States Patent
Manning et al.

(10) Patent No.: US 10,219,671 B2
(45) Date of Patent: Mar. 5, 2019

(54) SURFACE CLEANING DEVICE

(71) Applicant: TECHTRONIC FLOOR CARE TECHNOLOGY LIMITED, Tortola (VG)

(72) Inventors: Daragh Manning, Birmingham (GB); Darren Holmes, Birmingham (GB); Samuel Bennett, Birmingham (GB)

(73) Assignee: Techtronic Floor Care Technology Limited, Tortola (VG)

( * ) Notice: Subject to any disclaimer, the term of this patent is extended or adjusted under 35 U.S.C. 154(b) by 339 days.

(21) Appl. No.: 14/890,726

(22) PCT Filed: Feb. 7, 2014

(86) PCT No.: PCT/GB2014/050364
§ 371 (c)(1),
(2) Date: Nov. 12, 2015

(87) PCT Pub. No.: WO2014/184514
PCT Pub. Date: Nov. 20, 2014

(65) Prior Publication Data

US 2016/0113470 A1 Apr. 28, 2016

(30) Foreign Application Priority Data

May 15, 2013 (GB) ..... 1308750.7
May 15, 2013 (GB) ..... 1308779.6

(51) Int. Cl.
*A47L 1/05* (2006.01)
*A47L 11/40* (2006.01)
(Continued)

(52) U.S. Cl.
CPC ..... *A47L 11/4088* (2013.01); *A47L 1/05* (2013.01); *A47L 5/24* (2013.01); *A47L 7/0004* (2013.01);
(Continued)

(58) Field of Classification Search
CPC ..... A47L 11/4088; A47L 1/05; A47L 5/24; A47L 7/0004; A47L 7/0019; A47L 11/4016
See application file for complete search history.

(56) References Cited

U.S. PATENT DOCUMENTS 5,386,612 A 2/1995 Sham
5,590,439 A 1/1997 Famulus
(Continued)

FOREIGN PATENT DOCUMENTS

CN 2815256 9/2006
CN 202537394 U 11/2012
(Continued)

OTHER PUBLICATIONS

International Search Report for Application No. PCT/GB2014/050364 dated Jul. 14, 2014, 5 pages.
(Continued)

*Primary Examiner* — Robert J Scruggs
(74) *Attorney, Agent, or Firm* — Michael Best & Friedrich LLP

(57) ABSTRACT

A surface cleaning device including a surface-contacting assembly having a suction opening; a body; a suction source in fluid communication with the suction opening for sucking a fluid mixture of liquid and air from a surface; a rotation assembly mounted on the body for rotation relative to the body, the rotation assembly being rotationally fixed relative to the surface-contacting assembly, a separation chamber in which liquid is separated from the fluid mixture, the separation chamber providing a suction inlet in fluid communication with the suction opening, a suction outlet in fluid communication with the suction source, and a drainage outlet for connection to a receptacle for receiving liquid separated from the fluid mixture; and a receptacle for
(Continued)

receiving liquid separated from the fluid mixture via the drainage outlet.

23 Claims, 4 Drawing Sheets

(51) Int. Cl.
*A47L 5/24* (2006.01)
*A47L 7/00* (2006.01)

(52) U.S. Cl.
CPC ..... *A47L 7/0019* (2013.01); *A47L 11/4016* (2013.01)

(56) References Cited

U.S. PATENT DOCUMENTS

| | | | | |
|---|---|---|---|---|
| 6,101,668 | A * | 8/2000 | Grey | A47L 7/0009 15/322 |
| 6,931,690 | B2 | 8/2005 | Cox | |
| 8,544,146 | B2 | 10/2013 | Curien | |
| 2004/0221420 | A1* | 11/2004 | Phillips | A47L 1/08 15/401 |
| 2005/0022333 | A1* | 2/2005 | McDowell | A47L 5/30 15/320 |
| 2005/0091783 | A1* | 5/2005 | Sepke | A47L 9/0483 15/320 |
| 2014/0109340 | A1* | 4/2014 | Fischer | A47L 1/05 15/353 |

FOREIGN PATENT DOCUMENTS

| | | | |
|---|---|---|---|
| CN | 202654053 | | 1/2013 |
| EP | 2294961 | A2 | 3/2011 |
| FR | 2909275 | A1 | 6/2008 |
| FR | 2938177 | A1 | 5/2010 |
| GB | 2446772 | A | 8/2008 |
| GB | 2514153 | | 3/2016 |
| WO | 2009086892 | | 7/2009 |
| WO | 2010018312 | A2 | 2/2010 |
| WO | 2013143616 | | 10/2013 |

OTHER PUBLICATIONS

GB Search Report for Application No. GB1308750.7, dated Jul. 15, 2013, 1 page.
United Kingdom Patent Office Examination Report for 1308750.7 dated Aug. 11, 2015 (2 pages).
European Patent Office Examination Report for Application No. 14705389.6 dated Mar. 15, 2017, 4 pages.

* cited by examiner

SURFACE CLEANING DEVICE

CROSS-REFERENCE TO RELATED APPLICATIONS

This application is a Section 371 national phase application of International Application No. PCT/GB2014/050364, filed Feb. 7, 2014, which claims priority to U.K. Patent Application Nos. GB 1308750.7, filed May 15, 2013, and GB 1308779.6, filed May 15, 2013, the entire contents all of which are hereby incorporated by reference herein.

BACKGROUND

The present invention relates to a hard surface cleaning device.

Hard surfaces such as windows, tiled walls, and the like, are often cleaned using a liquid. Water with or without a detergent may be used to clean dirt from a surface. Once the surface has been made wet, it is typically wiped with a cloth or a bladed device to remove liquid from the surface before the liquid evaporates or dries naturally—in which case the liquid may leave a mark on the surface where detergent or dirt particles settle. It is preferable for the liquid to be removed from the surface without the liquid containing detergent and/or dirt particles being smeared across the surface.

SUMMARY

In one aspect, the present invention provides a suction device for cleaning a hard surface, whereby the liquid on the surface may be sucked from the surface, preventing smearing and ensuring that a significant proportion of the liquid is removed. The use of such a device avoids the need to use a cloth or other absorptive item to remove liquid, which results in the cloth being made dirty, which must then be cleaned and subsequently dried. Suction devices for sucking a fluid mixture of liquid and air from a hard surface are known. Such devices typically include a motorised impeller for drawing air through an air flow passage within the device, so as to create suction at the nozzle of the device. Within the body of the device, dirty liquid is separated from the air in a separating portion of the body, and drained into a tank, where it is stored until it is emptied by a user.

The separating portion of the device is typically provided within a chamber in which the liquid present within the fluid sucked from the surface is allowed to settle, or is passed through a separator, to extract the liquid from the fluid mix. Air is sucked towards the impeller, and liquid is allowed to drain into the tank. During use, devices are tilted through a range of angles when held by a user, in order for the user to contact different parts of a surface. For example, to reach the top portion of a window, the user holds the device at a different angle to that used when cleaning the bottom of the window. Therefore, it is beneficial for the wiping surface of the device to be pivotable relative to the body of the device.

In use it is advantageous to maintain the chamber at the optimum angle that provides for efficient separation of liquid from the fluid, obtaining maximum retention of liquid to drain to the tank, and minimum retention of liquid in the air moving to the impeller. In known cleaning devices, the separating chamber is tilted with the device as the device is moved from one part of the surface to another, resulting in suboptimal performance. By pivoting the chamber itself as the device is used, performance may be greatly improved.

Known cleaning devices also typically provide a single tank for storing dirty liquid sucked from the surface being cleaned. It is preferable to provide a source of clean water, or liquid containing detergent, to be sprayed onto the surface being cleaned.

According to a first aspect of the invention we provide a hard surface cleaning device including: a surface-contacting assembly having a suction opening; a body providing a suction source in fluid communication with the suction opening for sucking a fluid mixture of liquid and air from a hard surface; a rotation assembly mounted on the body for rotation relative to the body, the rotation assembly being rotationally fixed relative to the surface-contacting assembly, a separation chamber in which liquid is separated from the fluid mixture, the separation chamber providing a suction inlet in fluid communication with the suction opening, a suction outlet in fluid communication with the suction source, and a drainage outlet for connection to a receptacle for receiving liquid separated from the fluid mixture; and a receptacle for receiving liquid separated from the fluid mixture via the drainage outlet.

Further features of the first and second aspects of the invention are described in the appended claims.

DETAILED DESCRIPTION

Figure 1:
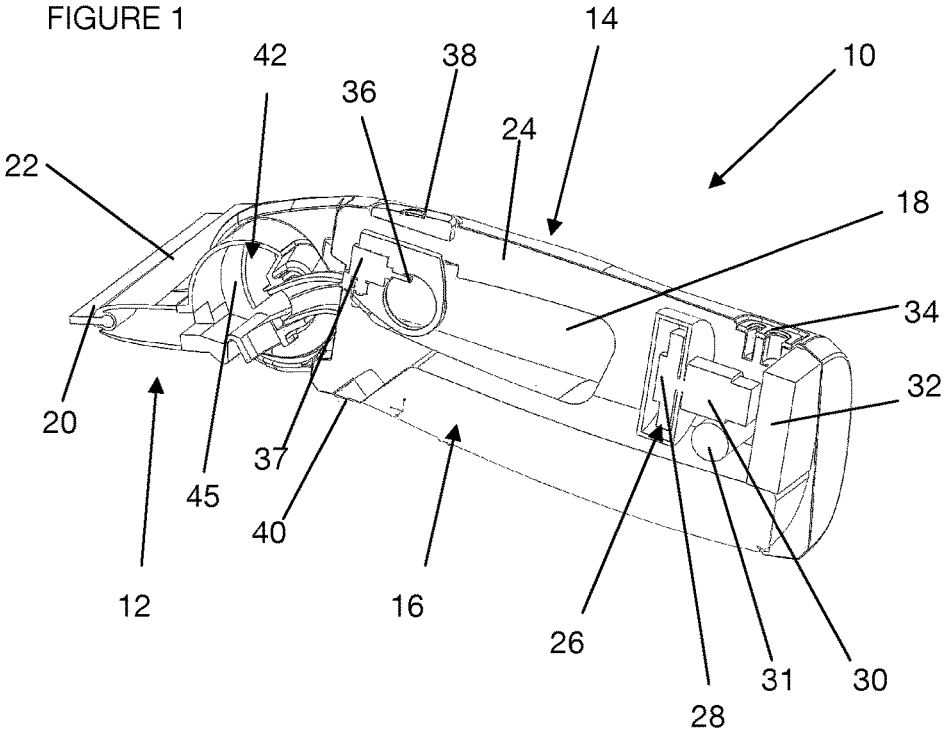
FIG. 1 shows a perspective partial cross-sectional view of a hard-surface cleaning device according to an embodiment of the invention.
Figure 2:
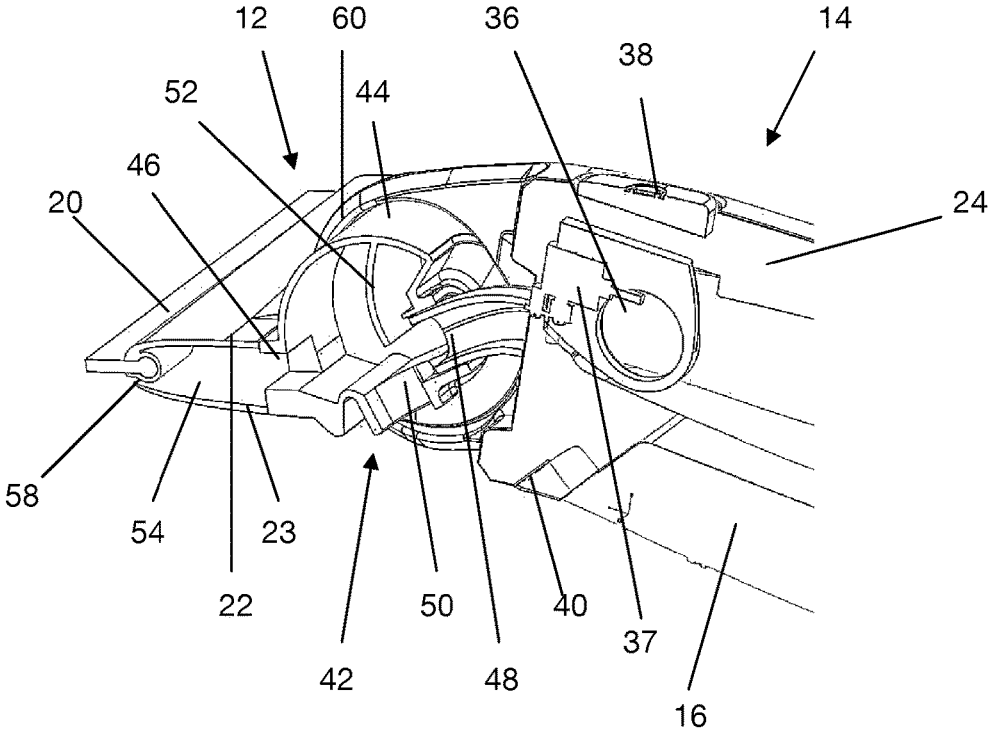
FIG. 2 is a perspective view of a portion of the device shown in FIG. 1.

With reference to the drawings, FIGS. 1 and 2 show a hard surface cleaning device 10. The device 10 includes a surface-contacting assembly 12 having a suction opening 58, a body 14 providing a suction source 26 in fluid communication with the suction opening 58 for sucking a fluid mixture of liquid and air from a hard surface. The device 10 also includes a rotation assembly 42 that is mounted on the body 14 for rotation relative to the body 14, the rotation assembly 42 being rotationally fixed relative to the surface-contacting assembly 12.

In embodiments, the rotation assembly 42 includes a separation chamber 45 in which liquid is separated from the fluid mixture sucked from the hard surface. The separation chamber 45 provides a suction inlet 46 in fluid communication with the suction opening 58, a suction outlet 48 in fluid communication with the suction source 26, and a drainage outlet 50 for connection to a receptacle 16 for receiving liquid separated from the fluid mixture. The receptacle 16 receives liquid separated from the fluid mixture via the drainage outlet 50.

While in embodiments the separation chamber 45 is disposed within the rotation assembly 42, for rotation with the surface-contacting assembly 12, in other embodiments the separation chamber 45 is disposed within the body 14, and does not rotate with the surface-contacting assembly 12.

The suction source 26 comprises an impeller 28 driven by a motor 30, arranged so that the air drawn through the impeller 28 is expelled from the device 10 through an outlet (not shown). In the embodiments shown, the suction source 26 is located towards the 'bottom' of the device when viewed with the surface-contacting assembly 12 uppermost, at the 'top'. The orientation will be used to describe the device throughout the description, for consistency.

The device 10 is powered by a power supply 31 assembled towards its lower end, for powering any powered components within the device. The power supply 32 may be removable and replaceable (e.g. a battery pack), by removing a part of the bodywork covering the device. Alternatively the power supply may be rechargeable via a power connection provided in the body of the device 10 (not shown). A printed circuit board 32 (PCB) is provided within the body 14, by which operation of the motor 30 is controlled.

The device 10 includes a power indicator 34 to display a light when the device is switched on. The power indicator 34 may provide an indication when the power of the power supply 32 is running low.

The body 14 of the device 10 also provides a passageway (indicated generally at 24) between the impeller 28 and the separation chamber 45, through which air is drawn by the suction created by the suction source 26.

In embodiments, the receptacle 16 is releasably securable to the body 14, to allow a user to detach the receptacle 16 so as to empty liquid from it. In such embodiments the body 14 provides a receiving slot for receiving the receptacle 16, and securing clips, or other securing means, to allow a user to secure the receptacle in position. In other embodiments, the receptacle 16 is formed integrally with the body 14. In such embodiments (not shown), an outlet may be provided in the receptacle 16, to allow a user to drain liquid from the receptacle 16.

In embodiments, the receptacle comprises a first volume and a second volume (not shown). The first volume has an inlet configured to receive liquid separated from the fluid mixture via the drainage outlet 50. The second volume is in fluid communication with a spray nozzle 40 provided on the body 14 of the device 10. A spray mechanism is provided, having a pump 37 actuated by a user-operated trigger 36, and a spray nozzle 40 in fluid communication with the receptacle 16, for spraying liquid from the receptacle 16.

Figure 3:
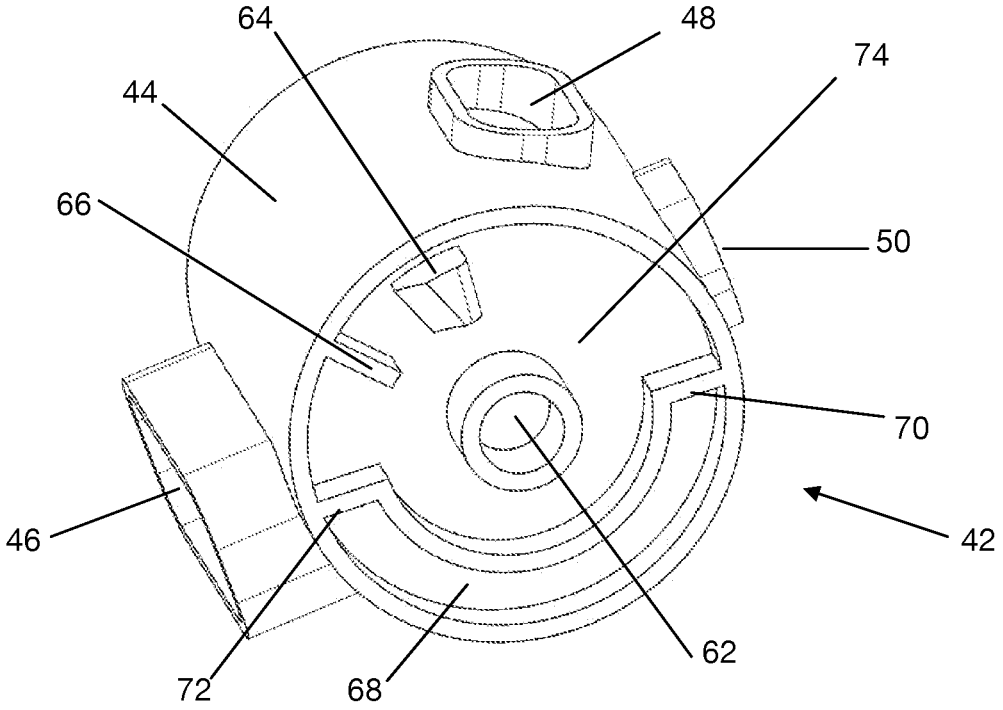
FIG. 3 is a perspective view of a rotation assembly according to an embodiment of the invention.
Figure 4:
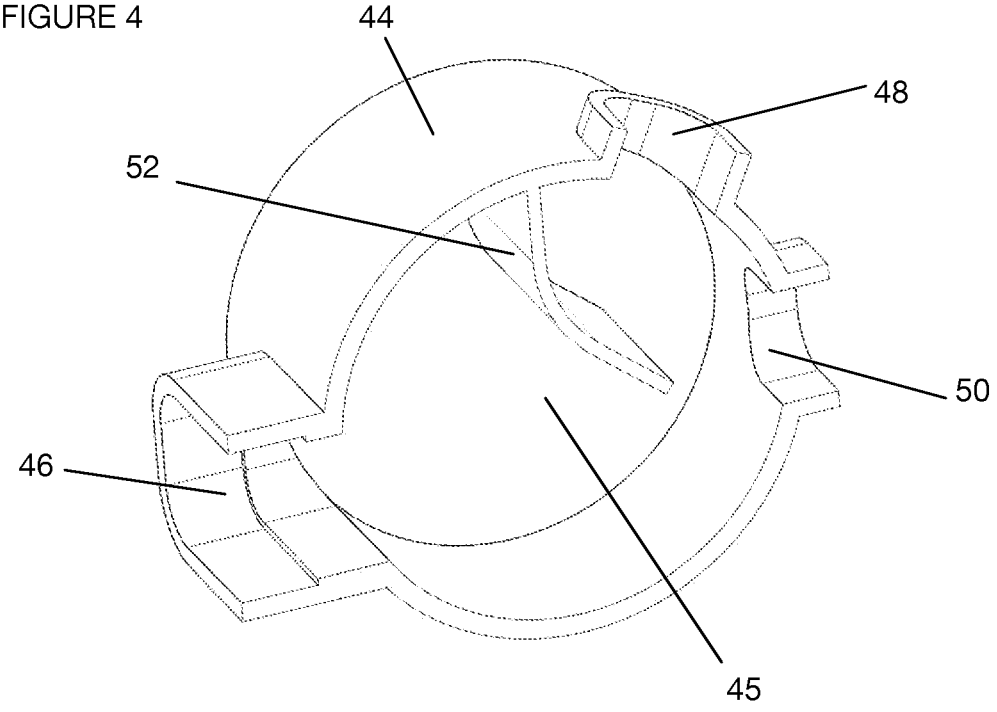
FIG. 4 is a perspective cross-sectional view of a rotation assembly according to an embodiment of the invention.

The rotation assembly 42 is shown in greater detail in FIGS. 3 and 4 of the drawings. The rotation assembly 42 is substantially cylindrical and forms the separation chamber 45 between a curved outer wall 44 and side walls 74. The rotation assembly 42 is configured to rotate about a rotational axis that is substantially aligned with its central axis. The body 14 provides a support formation 60 at its upper end that is disposed around at least a portion of the periphery 44 of the rotation assembly 42 so as substantially to prevent radial movement of the rotation assembly 42 relative to its rotational axis. The side walls 74 of the rotation assembly 42 provide respective recesses 62. In embodiments, as shown in FIG. 3, the recesses 62 may be provided by an annular formation that extends from the side wall 74. The recesses 62 are axially aligned and axially spaced from one another, on either side of the rotation assembly 42. The body 14 provides a pair of axial supports (not shown), each adapted to engage a respective recess 62 so as to enable rotational movement therebetween and substantially to prevent radial or axial movement therebetween. In embodiments the axial supports are rounded pins configured to fit within the recesses 62—not so tightly so as to restrict rotation therebetween, but tightly enough to prevent substantial radial or axial movement between the rotation assembly 42 and body 14. The surface-contacting assembly 12 of the device 10 is formed integrally with the rotation assembly 42, so as to rotate with the rotation assembly 42 relative to the body 14. The surface-contacting assembly 12 provides a first conduit 54 between the suction opening 58 and the suction inlet 46 of the separation chamber 45. The first conduit 54 is formed between a pair of walls 22, 23 that extend from the suction inlet 46 of the separation chamber 42 to a wiping formation formed at the end of the surface-contacting assembly 12. The wiping assembly includes a first wiping blade 20 formed as a substantially flat piece that extends across the width of the surface-contacting assembly 12, so as to provide a wide contact surface for displacing liquid from the surface being cleaned. The wiping blade 20 has a wiping edge along its edge distal from the body 14 of the device 10, adapted to abut a portion of a hard surface. Along its edge opposite the wiping edge is formed a rounded portion 78 of greater width, which is held within a cooperating rounded recess formed within the wiping assembly at the end the uppermost side wall 22. In use, the device 10 is held by the user with the wiping edge of the first wiping blade 20 in contact with the surface, and pulled across the surface, so that the wiping edge of the wiping blade 20 moves over the surface. In this way, the edge of the blade displaces liquid on the hard surface in the direction the device 10 is being moved by the user.

While in embodiments the rotation assembly 42 is substantially cylindrical and rotates about a central axis, it should be understood that other forms of rotational or pivoting configurations may be used, to allow the surface-contacting assembly 12 to pivot or rotate relative to the body 14. In such embodiments, the first conduit 54 extends through or past the rotation assembly 42 for connection with the suction inlet 46 of the separation chamber 45 which is disposed within the body 14. The first conduit 54 may be formed of a flexible material (such as rubber, for example), so that it may flex with rotation of the rotation assembly 42. In other embodiments, the rotation assembly 42 may define a passage that forms the first conduit 54, for connection to the suction inlet of the separation chamber 45.

In embodiments, the wiping assembly includes a second wiping blade with a respective wiping edge (not shown). The second wiping blade is spaced from the first wiping blade in a first direction. The first and second wiping blades are generally adjacent and parallel to one another, on either side of the suction opening 58. The first and second wiping blades are configured such that when portions of the blades abut a surface, and the blades are moved in the first direction (i.e. in the orientation shown in FIG. 1, the device 10 is moved downwardly, and the first blade is disposed above the second blade), this causes the wiping edge of each blade to flex in the second direction (i.e. upwards, in accordance with FIG. 1). A portion of the liquid displaced by the first blade is channelled onto the second blade, below the first blade, and the liquid is channelled towards the suction opening 58 via a surface of the second wiping blade. This arrangement effectively wipes liquid from the surface being cleaned using the first blade, and through the flexing of the blades against one another, displaces the liquid from the surface and onto the second blade, before it is sucked into the device 10.

The side walls 22, 23 of the surface-contacting assembly 12 extend from the outer wall 44 of the rotation assembly 42, through an aperture defined by the support formation 60. The connection between the support formation 60 and the outer wall 44 of the rotation assembly 42 is sealed, so as to prevent ingress of fluid into the body 14, and to prevent fluid leaking from within the body 14.

In embodiments (not shown), the surface-contacting assembly 12 includes a pad for wiping the hard surface. The pad may be a microfibre pad. The pad may be an absorptive pad. Alternatively, or in addition, the pad may be suitable for scrubbing dirt from a surface. The pad is disposed on a surface of the surface-contacting assembly. Preferably, the pad is attachable to the lowermost wall of the assembly 23 (i.e. adjacent the second wiping blade). This provides a convenient portion of the device 10 for allowing a user to wipe the surface with the pad, in order to absorb any left-over liquid on the surface that the device is unable to suck from the surface, or to clear debris from the surface to prevent it clogging up the opening 58 of the device. In embodiments, the pad is releasably secured by a plurality of hook and loop formations disposed on the side wall 23 and on the pad, respectively. An example of such a releasable attachment mechanism is Velcro®.

The body 14 of the device 10 provides a second conduit 24 between the suction outlet 48 and the suction source 26, such that a flow path is defined between the suction opening 58 and the suction source 26 through the first conduit 54, the separation chamber 45, and the second conduit 24. In embodiments, the second conduit 24 is provided by a channel disposed within the handle of the device 10.

The handle is formed by a aperture 18 defined by the body 14, providing a space into which a user may insert a hand so as to grip the handle and operate the pump trigger 36 provided within the aperture. The power button 38 for turning the suction source 26 on and off is provided at a convenient location on the body 14 to enable a user to operate the button 38 using a thumb, while holding the device 10.

The separation chamber 45 provides a volume into which liquid-laden air flows through the suction inlet 46. Liquid sucked into the suction opening 58 of the device 10 may also run through the first conduit 54 and into the separation chamber 45, in liquid form. When the device 10 is held in its normal 'in use' orientation (i.e. between the orientation shown in FIG. 1, and a more upright position in which the surface-contacting assembly 12 is uppermost), liquid entering the separation chamber 45 runs through the chamber 45 and through the drainage outlet 50.

The suction inlet 46, suction outlet 48 and drainage outlet 50 are spaced from one another around the outer wall 44 of the separation chamber 45. A deflection surface 52 is provided within the separation chamber 45, such that a portion of the fluid travelling on the flow path through the separation chamber 45, from the suction inlet 46 to the suction outlet 48 is incident upon the deflection surface 52. The deflection surface 52 is formed by a wall disposed across a portion of the chamber 45, obstructing clear passage between the suction inlet 46 and suction outlet 48. In the example embodiment shown in FIG. 5, the deflection surface 52 extends from the outer wall 44, between the side walls 74 of the separation chamber 45. By causing fluid entering the chamber 45 to change direction, and to flow around the deflection surface 52, the speed of the flow of fluid through the chamber is slowed, which increases the formation of liquid from the liquid-laden fluid within the separation chamber 45. Furthermore, incidence of the fluid on the deflection surface 52 causes liquid to be deposited on the deflection surface 52.

In other embodiments, the deflection surface 52 does not extend to the outer wall 44 of the separation chamber 45 but stops short of the wall 44. One or more additional deflection surfaces (not shown) may be provided within the separation chamber 45.

One or more ribs (not shown) may also be provided within the chamber 45, the ribs extended from the outer wall 44 between the side walls 74, at positions in which it is advantageous to prevent liquid flowing around the walls of the chamber 45. For example, it may be advantageous to provide a rib extending from the outer wall 44 of the chamber adjacent the suction inlet 46, so that if the device 10 is inadvertently inverted, liquid that has formed within the chamber 45 runs along the outer wall 44 and into contact with the rib, thus blocking the passage of liquid out of the chamber 45 through the suction inlet 46.

It may be advantageous for a rib to be provided adjacent the drainage outlet 50, positioned between the drainage outlet 50 and the suction outlet 48, so that the flow of liquid from around the drainage outlet 50 towards the suction outlet 48 is reduced or avoided.

The drainage outlet 50 is connected to an inlet of the receptacle 16, by a flexible sleeve (not shown), allowing liquid to drain from the separation chamber 45 into the receptacle (or into the first volume of the receptacle, in embodiments). The flexible sleeve may be formed of rubber, for example. An end of the conduit is secured to the drainage outlet 50 so as to provide a seal preventing fluid from escape from the separation chamber 45 via the drainage outlet 50 other than by passing through the flexible sleeve. A passage (not shown) is defined within the body 14 of the device 10, in which the other end of the flexible sleeve is disposed—that end being substantially sealed within the passage, so that fluid flows through the flexible sleeve and into the passage and/or into the inlet of the receptacle 16.

The suction outlet 48 is connected to the second conduit 24 by another, similar, flexible sleeve. That sleeve is connected to the suction outlet 48 at one end, and at its other end sleeve is sealed to the second conduit 24, which leads to the suction source 26.

In embodiments, a sealed chamber (not shown) is formed between the body 14 and the separation chamber 45 around the suction outlet 48, such that fluid passing from the separation chamber 45 to the second conduit 24 is substantially prevented from escaping the second conduit 24 around the suction outlet 48. In embodiments, a sealed chamber (not shown) is formed between the body 14 and the separation chamber 45 around the drainage outlet 50, such that fluid passing from the separation chamber 45 to the receptacle 16 is substantially prevented from escaping the body 14 around the drainage outlet 50.

In alternative embodiments from those shown in the Figures, the drainage outlet 50 and suction outlet 48 may be provided in a position aligned with one another across the width of the separation chamber 45—i.e. spaced in a direction axially across the chamber 45, between the side walls 74. In such a configuration, the deflection surface 52 may extend from a part of the outer wall 44 lying between the suction outlet 48 and drainage outlet 50, in a direction across the chamber 45 so as to block the direct passage of fluid between the suction inlet 46 and suction outlet 48.

The receptacle 16 and/or the passage within the body 14 is provided with a non-return valve (not shown) or by a similar arrangement, that prevents (or substantially prevents) liquid from flowing out of the receptacle 16 if the device 10 is inverted.

Figure 5:
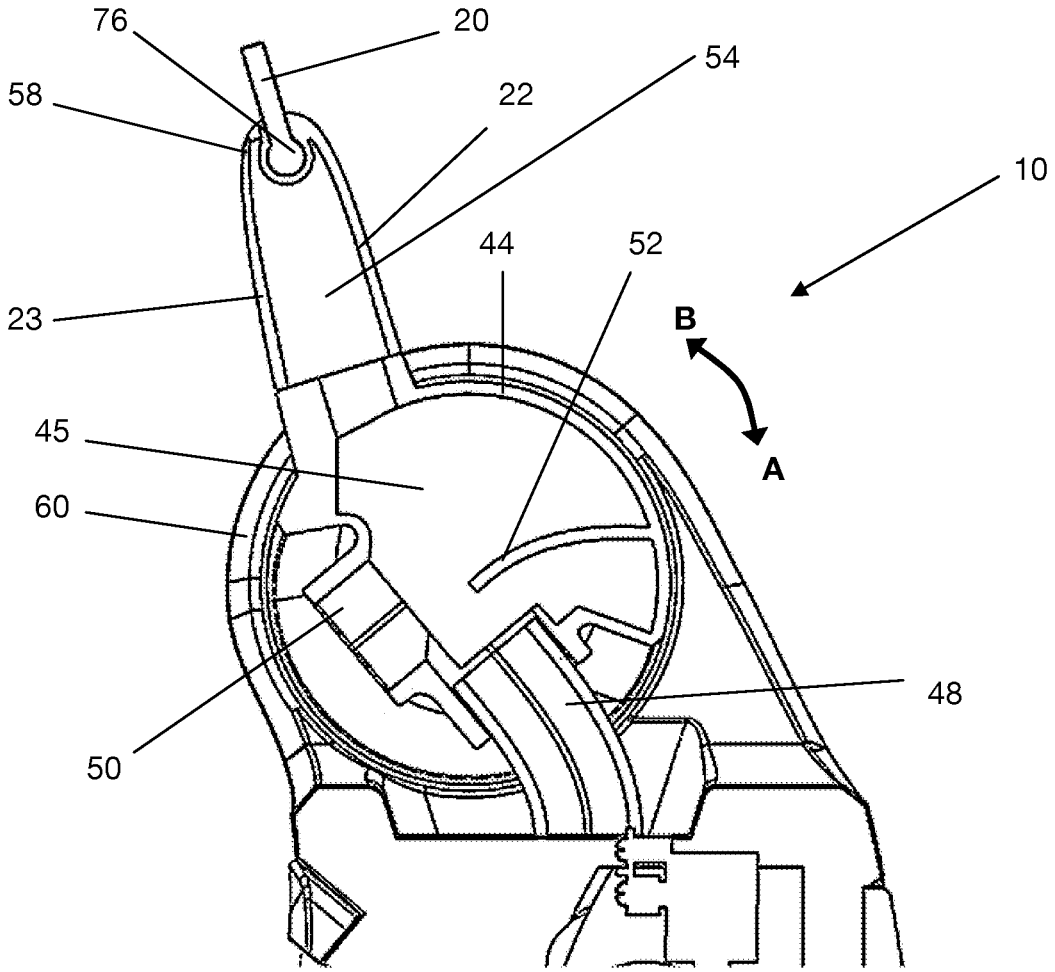
FIG. 5 is a cross-sectional side view of a portion of the device shown in FIG. 1.
Figure 6:
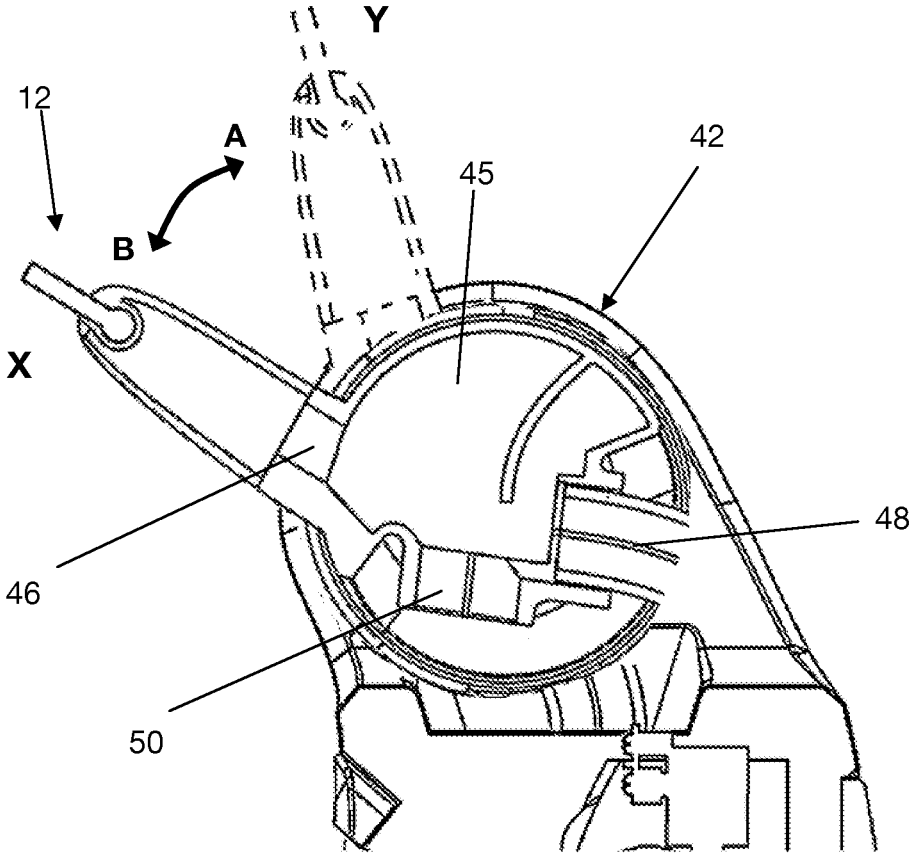
FIG. 6 is a cross-section side view of a portion of the device shown in FIG. 1, in a first and a second rotational orientation.

As shown in FIGS. 5 and 6, the body 14 and the rotation assembly 42 are configured to rotate relative to one another in a first direction (indicated as direction 'A') and in a second, opposite, direction (indicated as direction 'B'), between a first configuration (as shown at 'X' in FIG. 6) and a second configuration (as shown at 'Y' in FIG. 6). A spring (not shown) is provided between a portion of the body 14 (not shown) and a portion of the rotation assembly 70. The spring may be a torsional spring, a compression spring or a tension spring. The spring is located in a channel 68 formed between a side wall of the rotation assembly 42 and a portion of the casing forming the body 14, and between an end wall 70,72 of the channel 68 and a biasing member that projects into the channel 68 from the casing of the body 14.

If the spring is a tension spring, the spring is located adjacent the end wall 70 so as to bias the biasing member against rotation in the first direction A. In this configuration, the spring biases the rotation assembly 42 into its first configuration—its natural rotational position relative to the body 14, as shown as configuration X. In this position, the spring biases the surface-contacting assembly 12 and rotational assembly 42 against relative rotation with the body 14 in the first direction A. If the spring is a compression spring, the spring should be located adjacent the end wall 72, at the opposite end of the channel 68, and secured to both the end wall 72 and to the biasing element, to achieve the same effect. A torsional spring could be secured to a portion of the side wall of the rotation assembly, and to a portion of the body 14, to achieve the same effect.

The device 10 further includes a first detent (not shown) provided on the body 14 and a second detent 64 provided on the rotation assembly 42. In the embodiment shown, the second detent 64 is provided on a side wall 74 of the rotation assembly 42. The pair of detents are moveable between a first configuration (equivalent to the first configuration X of the device 10) and a second configuration (equivalent to the second configuration Y of the device 10), such that when in the first configuration relative rotation between the rotation assembly 42 and body 14 the first direction (A) causes the first and second detents to abut one another to resist further relative rotation in the first direction (A). Further rotation of the rotation assembly 42 relative to the body 14 in the first direction (A), past the position in which the first and second detents abut one another, causes disengagement of the first and second detents and movement to the second configuration (Y), in which resistance against rotation in the first direction (A) is removed. Rotation in the second direction (B) from the second configuration (Y) causes abutment of the first and second detents once again. This causes resistance against further relative rotation in the second direction (B), and further rotation in the second direction (B) past the position in which the first and second detents abut one another, causes disengagement of the first and second detents and movement to the first configuration (X).

A pair of cooperating stop formations is provided on the body 14 (not shown) and rotation assembly 42 (indicated at the position of the end wall 70), respectively, adapted to abut one another on relative rotation between the rotation assembly 42 and body 14 in the first direction (A), to prevent further rotation in the first direction (A) beyond the position of the second configuration (Y). A further pair of cooperating stop formations (not shown) is provided on the body 14 and rotation assembly 42 (shown at 66), respectively, adapted to abut one another on relative rotation between the rotation assembly 42 and body 14 in the second direction (B), to prevent further rotation in the second direction (B) beyond the position of the first configuration (X).

In use, the device 10 is held by a user in its first configuration, indicated at X in FIG. 6. The wiping assembly of the surface-contacting assembly 12 is held towards the top of a window, for example, with the wiping edge of the wiping blade 20 pressed against the surface of the window. The user moves the blades 20 downwards as the suction source 26 is operated, causing the blades to flex upwardly at the wiping edge as the device 10 is moved downwards, and liquid on the window to be channelled through the suction opening 58. As the user moves the device 10 downwards, the frictional force exerted upwards by the surface on the surface-contacting assembly 12 causes the movement in direction A, against the biasing force of the spring. Application of sufficient force to the device 10 causes rotation in direction A against the biasing force. At a given rotational position, the detents abut one another, thus increasing the resistance to further rotation in direction A. Again, the application of sufficient force causes the detents to overlap and pass one another, reducing the resistance to rotational movement. Once the device 10 has reached configuration Y, a pair of cooperating stop formations abut one another to prevent further rotation. At this stage the user may remove the device 10 from the window, thus releasing the force on the surface-contacting assembly 12. At this point, the spring biases the rotation assembly 42 back towards configuration X, in direction B. Again, the detents abut one another to resist further rotation. The force of the spring may be sufficient to move the detents past one another, to their first configuration. Alternatively, the user may apply a force to the surface-contacting assembly 12 to move the device 10 back to its first configuration X.

In embodiments, the angle of rotation between configurations X and Y is between 10 and 90 degrees. Preferably, the angle of rotation between configurations X and Y is in the range 30 to 70 degrees, and more preferably, approximately 50 degrees.

In embodiments, and as shown in FIGS. 5 and 6, the axis of rotation of the surface-contacting assembly 12 is not coaxial with the axis of rotation of the rotation assembly 42. In other embodiments, the axis of rotation of the surface-contacting assembly 12 is coaxial with the axis of rotation of the rotation assembly 42.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A surface cleaning device including:

a surface-contacting assembly having a suction opening;

a body providing a support formation;

a suction source in fluid communication with the suction opening configured to suck a fluid mixture of liquid and air from a surface;

a rotation assembly mounted on the body for rotation relative to the body, the rotation assembly being rotationally fixed relative to the surface-contacting assembly, the rotation assembly including a rotational axis and a central axis, the rotation assembly being substantially cylindrical and the rotational axis being substantially aligned with the central axis, and the support formation being disposed around at least a portion of a periphery of the rotation assembly so as substantially to prevent radial movement of the rotation assembly relative to the rotational axis of the rotation assembly;

a separation chamber in which liquid is separated from the fluid mixture, the separation chamber including a suction inlet in fluid communication with the suction opening, a suction outlet in fluid communication with the suction source, and a drainage outlet; and a receptacle connected to the drainage outlet for receiving liquid separated from the fluid mixture via the drainage outlet.

2. A surface cleaning device according to claim 1 wherein the receptacle is releasably securable to the body, to allow a user to detach the receptacle from the body so as to empty liquid from the receptacle.

3. A surface cleaning device according to claim 1, wherein the rotation assembly includes a pair of recesses that are axially aligned and axially spaced from one another, and the body includes a pair of axial supports, each adapted to engage a respective recess so as to enable rotational movement therebetween and substantially to prevent radial or axial movement therebetween.

4. A surface cleaning device according to claim 1, wherein the body includes a pair of recesses that are axially aligned and axially spaced from one another, and the rotation assembly provides a pair of axial supports, each adapted to engage a respective recess so as to enable rotational movement therebetween and substantially to prevent radial or axial movement therebetween.

5. A surface cleaning device according to claim 1, wherein the surface-contacting assembly is formed integrally with the rotation assembly, so as to rotate with the rotation assembly relative to the body.

6. A surface cleaning device according to claim 1, wherein the surface-contacting assembly includes a first conduit between the suction opening and the suction inlet and the body includes a second conduit between the suction outlet and the suction source, such that a flow path is defined between the suction opening and the suction source through the first conduit, the separation chamber, and the second conduit.

7. A surface cleaning device according to claim 6, wherein a deflection surface is provided within the separation chamber, such that a portion of the fluid travelling on the flow path through the separation chamber from the suction inlet to the suction outlet is incident upon the deflection surface.

8. A surface cleaning device according to claim 6, wherein a sealed chamber is formed between the body and the separation chamber around the suction outlet, such that fluid passing from the separation chamber to the second conduit is substantially prevented from escaping the second conduit around the suction outlet.

9. A surface cleaning device according to claim 1 further comprising a spray mechanism having a pump actuated by a user-operated trigger, and a spray nozzle in fluid communication with the receptacle, for spraying liquid from the receptacle.

10. A surface cleaning device according to claim 9, wherein the receptacle comprises a first volume and a second volume, such that the first volume is configured to receive liquid separated from the fluid mixture via the drainage outlet, and the second volume is in fluid communication with the spray nozzle.

11. A surface cleaning device according to claim 10, wherein the second volume is configured to allow a user to fill the second volume at least partially with liquid.

12. A surface cleaning device according to claim 1, wherein the surface-contacting assembly includes a first wiping blade having a wiping edge adapted to abut a portion of a surface for displacing liquid on the surface.

13. A surface cleaning device according to claim 12, wherein the surface-contacting assembly includes a second wiping blade with a respective wiping edge, the second wiping blade being spaced from the first wiping blade in a first direction, the suction opening being disposed between the first and second wiping blades, and the first and second wiping blades being configured such that when portions of the blades abut a surface, movement of the surface-contacting assembly in the first direction causes the wiping edge of each blade to flex in the second direction, wherein a portion of the liquid displaced by the first blade is channelled towards the suction opening via a surface of the second wiping blade.

14. A surface cleaning device according to claim 12, wherein the surface-contacting assembly includes a pad for wiping the surface, the pad being disposed on a surface of the surface-contacting assembly.

15. A surface cleaning device according to claim 14 wherein the pad is releasably secured to the surface of the surface-contacting assembly by a plurality of hook and loop formations disposed on the assembly and on the pad, respectively.

16. A surface cleaning device according to claim 1, wherein the body includes a handle for a user to grasp the device.

17. A surface cleaning device according to claim 1, wherein the rotation assembly includes the separation chamber.

18. A surface cleaning device comprising:

a surface-contacting assembly having a suction opening;

a body;

a suction source in fluid communication with the suction opening configured to suck a fluid mixture of liquid and air from a surface;

a rotation assembly mounted on the body for rotation relative to the body, the rotation assembly being rotationally fixed relative to the surface-contacting assembly, wherein the body and the rotation assembly are configured to rotate relative to one another in a first direction and in a second, opposite, direction, wherein a spring is provided between a portion of the body and a portion of the rotation assembly and the spring biases the rotation assembly against relative rotation between the rotation assembly and body in the first direction;

a separation chamber in which liquid is separated from the fluid mixture, the separation chamber including a suction inlet in fluid communication with the suction opening, a suction outlet in fluid communication with the suction source, and a drainage outlet; and a receptacle connected to the drainage outlet for receiving liquid separated from the fluid mixture via the drainage outlet.

19. A surface cleaning device according to claim 18, further including a first detent provided on the body and a second detent provided on the rotation assembly, moveable between a first configuration and a second configuration, such that when in the first configuration relative rotation between the rotation assembly and body in the first direction causes the first and second detents to abut one another to resist further relative rotation in the first direction.

20. A surface cleaning device according to claim 19, wherein further rotation of the rotation assembly relative to the body in the first direction, past the position in which the first and second detents abut one another, causes disengagement of the first and second detents and movement to the second configuration, in which resistance against rotation in the first direction is removed.

21. A surface cleaning device according to claim 19, wherein rotation in the second direction from the second configuration causes abutment of the first and second detents, so as to resist further relative rotation in the second direction, and wherein further rotation in the second direction past the position in which the first and second detents abut one another, causes disengagement of the first and second detents and movement to the first configuration.

22. A surface cleaning device according to claim 18, wherein a pair of cooperating stop formations is provided on the body and rotation assembly, respectively, adapted to abut one another on relative rotation between the rotation assembly and body in the first direction, to prevent further rotation in the first direction.

23. A surface cleaning device according to claim 18, wherein a further pair of cooperating further stop formations is provided on the body and rotation assembly, respectively, adapted to abut one another on relative rotation between the rotation assembly and body in the second direction, to prevent further rotation in the second direction.

* * * * *